US006608903B1

(12) United States Patent
Miyazaki et al.

(10) Patent No.: US 6,608,903 B1
(45) Date of Patent: Aug. 19, 2003

(54) SOUND FIELD REPRODUCING METHOD AND APPARATUS FOR THE SAME

(75) Inventors: Hideo Miyazaki, Hamamatsu (JP); Yasushi Shimizu, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 517 days.

(21) Appl. No.: 09/640,348

(22) Filed: Aug. 16, 2000

(30) Foreign Application Priority Data

Aug. 17, 1999 (JP) ..... 11-230437
Sep. 20, 1999 (JP) ..... 11-265966

(51) Int. Cl.[7] ..... H04R 5/00
(52) U.S. Cl. ..... 381/17; 381/19; 381/26
(58) Field of Search ..... 381/1, 17, 18, 381/19, 303, 304, 305, 26, 92, 91, 307

(56) References Cited

U.S. PATENT DOCUMENTS

| | | | | | |
|---|---|---|---|---|---|
| 2,778,874 | A | * | 1/1957 | Mueller | 381/26 |
| 4,096,353 | A | * | 6/1978 | Bauer | 381/17 |
| 5,173,944 | A | * | 12/1992 | Begault | 381/17 |
| 5,260,920 | A | | 11/1993 | Ide et al. | 381/63 |
| 5,438,623 | A | * | 8/1995 | Begault | 381/17 |
| 5,638,343 | A | * | 6/1997 | Ticknor | 381/17 |
| 5,666,425 | A | * | 9/1997 | Sibbald et al. | 381/26 |
| 6,430,293 | B1 | * | 8/2002 | Finsterle | 381/17 |

FOREIGN PATENT DOCUMENTS

| | | |
|---|---|---|
| JP | 444499 | 2/1992 |
| JP | 4158000 | 5/1992 |
| JP | 5153688 | 6/1993 |
| JP | 5276592 | 10/1993 |
| JP | 6335096 | 12/1994 |
| JP | 7154893 | 6/1995 |

OTHER PUBLICATIONS

Kawakami, et al. "Consideration on Simulating the Sound Field," Nippon Gakki Co. Ltd. pp. 1–4.

* cited by examiner

*Primary Examiner*—Xu Mei
(74) *Attorney, Agent, or Firm*—Pillsbury Winthrop LLP

(57) ABSTRACT

A space surrounding a sound source (S) which is set in a sound field (10) to be reproduced is divided into sound source element regions (S1 to Sn), and a space surrounding a sound receiving point (R) is divided into sound receiving element regions (R1 to Rm). An impulse response when a sound radiated from the sound source (S) is emitted from one of the sound source element regions (S1 to Sn), passes through the sound field (10), enters one of the sound receiving element regions (R1 to Rm), and then reaches the sound receiving point (R) is obtained for each of combinations of the sound source element regions (S1 to Sn) and the sound receiving element regions (R1 to Rm). A sound emitted from a real sound source (Sr) in an arbitrary real space (26) is picked up by microphones (MC1 to MCn) placed correspondingly with the sound source element regions (S1 to Sn). In an FIR matrix circuit (42), the pickup signals are respectively subjected to a convolution operation with impulse responses which are obtained for each of the sound source element regions (S1 to Sn) in corresponding directions.

13 Claims, 10 Drawing Sheets

SOUND FIELD REPRODUCING METHOD AND APPARATUS FOR THE SAME

BACKGROUND OF THE INVENTION

1. Field of The Invention

The present invention relates to a sound field reproducing method of reproducing an arbitrary sound field such as a concert hall, in another space, and also relates to an apparatus for implementing the method. According to the present invention, sound differences due to performance conditions such as directional properties of a sound source such as a musical instrument and the direction of a performer can be reproduced, thereby enabling a sound field to be reproduced with higher presence.

The present application is based on Japanese Patent Application Nos. Hei. 11-230437 and Hei. 11-265966, which are incorporated herein by reference.

2. Description of the Related Art

A related technique of reproducing of an arbitrary sound field such as a concert hall, in a listening room, a laboratory, or the like will be described. As shown in FIG. 2, a sound source S is set on, for example, a stage 12 in a sound field 10 as a concert hall which is to be reproduced, and a sound receiving point R is set in audience seats 14 or the like. As shown in FIG. 3, the space surrounding the sound receiving point R is divided into sound receiving element regions R1, R2, Rj, . . . , and Rm of an appropriate solid angle in which the sound receiving point R is centered. In the example of FIG. 3, the horizontal plane is divided into eight regions, and the obliquely upper area into four regions. In total, the space is divided into twelve regions (m=12). As shown in FIG. 4 (the sound receiving element regions R1 to Rm in FIGS. 4 and 6 diagrammatically show the manner of the division in FIG. 3), an omnidirectional sound source is used as the sound source S. A sound which is radiated from the sound source S, passes through the sound field 10, and then reaches the sound receiving point R is measured by a directional microphone or calculated for each of directions. On the basis of results of the measurements or calculations, an impulse response when the sound radiated from the sound source S passes through the sound field 10, enters one of the sound receiving element regions R1 to Rm, and then reaches the sound receiving point R is obtained for each of the sound receiving element regions R1 to Rm.

FIG. 5 shows the configuration of a system for reproducing the sound field 10 in an arbitrary real space on the basis of the obtained impulse responses hl to hm respectively for the sound receiving element regions R1 to Rm. In an arbitrary real space 16 such as a listening room or a laboratory, loudspeakers SP1 to SPm are placed around a real sound receiving point Rr (usually, a center portion of a plane in the space 16) where a listener or a test subject listens the sound, and in directions corresponding to the sound receiving element regions R1 to Rm (FIG. 3), respectively (in FIG. 5, the positions where the loudspeakers SP1 to SPm are placed are diagrammatically shown in accordance with the manner of showing the sound receiving element regions R1 to Rm in FIG. 4). Right and left or two-channel sound signals which are played back from a sound source apparatus 18 such as a DAT (i.e., Digital Audio Tape recorder) or a CD (i.e., Compact Disc) player are combined into one channel signal and then input into FIR filters (convolution operating units) 20-1 to 20-m via an head amplifier 19. In the FIR filters 20-1 to 20-m, the obtained impulse responses hl to hm are preset as parameters of a convolution operation, respectively. The one-channel sound signal is subjected to a convolution operation in each of the FIR filters 20-1 to 20-m, and sound signals (reflected sound signals) respectively for the directions corresponding to the sound receiving element regions R1 to Rm are produced. The produced sound signals are amplified by amplifiers 22-1 to 22-m, and then played back by the corresponding loudspeakers SP1 to SPm, respectively. The sound signals which are played back in the form of right and left or two-channel sounds from the sound source apparatus 18 are additionally played back as they are as direct sounds at front right and left positions with respect to the sound receiving point Rr. Therefore, the listener at the sound receiving point Rr can enjoy the music in an atmosphere which enables the listener to feel as if the listener is in the audience seats 14 in the sound field 10 of FIG. 2.

In the above, the state where the music performed on the stage 12 of FIG. 2 is listened in the audience seats 14 is reproduced has been described. When a state where the music performed on the stage 12 is listened in real time on the stage 12 is reproduced, it is possible to conduct a rehearsal or the like in an atmosphere which enables a performer to feel as if the performer is in the sound field 10. The reproduction technique will be described. In the sound field 10 of FIG. 2, the sound source S on the stage 12 is set also as the sound receiving point R. The space surrounding the sound receiving point R (=the sound source S) is divided into sound receiving element regions R1 to Rm of an appropriate solid angle in which the sound receiving point R is centered in the same manner as FIG. 3. As shown in FIG. 6, an omnidirectional sound source is used as the sound source S, and a sound which is radiated from the sound source S, passes through the sound field 10, and then reaches the sound receiving point R (=the sound source S) is measured by a directional microphone or calculated for each of directions. On the basis of results of the measurements or calculations, an impulse response when the sound radiated from the sound source S passes through the sound field 10, enters one of the sound receiving element regions R1 to Rm, and then reaches the sound receiving point R is obtained for each of the sound receiving element regions R1 to Rm.

FIG. 7 shows the configuration of a system for reproducing the sound field 10, in an arbitrary real space on the basis of the obtained impulse responses hl to hm respectively for the sound receiving element regions R1 to Rm. In an arbitrary real space 16 such as a listening room or a laboratory, a microphone 24 is placed at a position which is, for example, above that where the performer is to give a performance (the real sound source Sr and the real sound receiving point Rr, usually, a center portion of a plane in the space 16), and loudspeakers SP1 to SPm are placed around the performing position and in directions corresponding to the sound receiving element regions R1 to Rm (FIG. 3), respectively (in FIG. 7, the positions where the loudspeakers SP1 to SPm are placed are diagrammatically shown in accordance with the manner of showing the sound receiving element regions R1 to Rm in FIG. 6). A one-channel sound signal (performance signal) which is picked up by the microphone 24 is input into FIR filters (convolution operating units) 20-1 to 20-m via a head amplifier 19. In the FIR filters 20-1 to 20-m, the obtained impulse responses hl to hm are preset as parameters of a convolution operation, respectively. The one-channel sound signal is subjected to a convolution operation in each of the FIR filters 20-1 to 20-m, and sound signals (reflected sound signals) for the directions corresponding to the sound receiving element regions R1 to Rm are produced. The produced sound signals are amplified by amplifiers 22-1 to 22-m, and then played back by the corresponding loudspeakers SP1 to SPm, respectively. Therefore, the performer at the sound source S and the sound receiving point Rr can conduct a rehearsal in an atmosphere which enables the performer to feel as if the performer is on the stage 12 in the sound field 10 of FIG. 2.

In the sound field reproducing method of the related art, the impulse responses hl to hm respectively for the sound receiving element regions R1 to Rm which are obtained with assuming that the sound source S is omnidirectional are used. In the real sound field 10, however, impulse responses are affected by the directional properties of the sound source S. With respect to a musical instrument of high directionality such as a trumpet, for example, both a listener in the audience seat 14, and a performer feel a large change in audible sensation in cases where the performer on the stage 12 gives a performance with facing toward the audience seats 14, and where the performer gives a performance with facing in a lateral direction with respect to the audience seats 14. In the related sound field reproducing method, even when the performer positioning directly below the microphone 24 turns in the horizontal plane while playing a trumpet, for example, in the system configuration of FIG. 7, the sounds played back from the loudspeakers SP1 to SPm are not changed. In other words, the method cannot reproduce sound differences due to directional properties of a musical instrument or the direction of a performer.

SUMMARY OF THE INVENTION

It is an object of the present invention to provide a sound field reproducing method which can solve the problems of the related art and reproduce sound differences due to performance conditions such as directional properties of a sound source such as a musical instrument and the direction of a performer, thereby enabling a sound field to be reproduced with higher presence, and also an apparatus for implementing the method.

To achieve the above object, according to the first aspect of the present invention, there is provided a sound field reproducing method which comprises the steps of dividing a space surrounding a sound source disposed in a sound field which is to be reproduced, into sound source element regions of an appropriate solid angle in which the sound source is centered, dividing a space surrounding a sound receiving point disposed in the sound field, into sound receiving element regions of an appropriate solid angle in which the sound receiving point is centered, calculating or measuring impulse responses, for each of combinations of the sound source element regions and the sound receiving element regions, wherein each of the impulse responses is calculated or measured in the sound field in which a sound radiated from the sound source is emitted from at least one of the sound source element regions, passes through the sound field, enters at least one of the sound receiving element regions, and reaches the sound receiving point, placing a plurality of microphones at positions which surround a real sound source in an arbitrary real space and at an appropriate distance in directions corresponding to the sound source element regions, respectively, placing a plurality of loudspeakers at positions which surround a real sound receiving point in an arbitrary real space and at an appropriate distance in directions corresponding to the sound receiving element regions, respectively, picking up a sound radiated from the real sound source, by the microphones to produce pickup signals, subjecting the pickup signals respectively to convolution operations with the impulse responses which are calculated or measured for the sound source element regions in directions corresponding respectively to the sound radiated from the real sound source, and reproducing respectively sound signals which are obtained by the convolution operations, from the loudspeakers which are placed correspondingly to the sound receiving element regions of corresponding directions, respectively.

Accordingly, when a musical instrument having directionality is played, different sounds are played back depending on the direction of the musical instrument. In a real space in which a performance is to be given, when a performer gives a performance with facing in the direction which corresponds to that on a stage in a sound field to be reproduced, and toward the front of the audience seats, the performance is listened as if the performer gives the performance with facing toward the audience seats, and, when the performer gives a performance with facing in a direction which corresponds to that on the stage and in opposite to the audience seats, the performance is listened as if the performer gives the performance with directing the back toward the audience seats. In this way, sound differences due to performance conditions such as directional properties of a sound source such as a musical instrument and the direction of a performer can be reproduced, thereby enabling a sound field to be reproduced with higher presence.

In the sound field reproducing method of the present invention, a series of operations of the pickups by the microphones, the convolution operations with the impulse responses, and the playbacks by the loudspeakers may be performed, for example, in real time. The signals picked up by the microphones may be once recorded and then played back, and the played back signals may be subjected to the convolution operations with the impulse responses and then played back from the loudspeakers. The sound source and the sound receiving point may be set at the same position in the sound field which is to be reproduced, and the impulse responses may be then obtained. The sound source and the sound receiving point may be set at different positions in the sound field which is to be reproduced, and the impulse responses may be then obtained. The real sound source which gives a performance or the like, and the real sound receiving point where the performance is listened may be set at the same position in the same space. The real sound source which gives a performance or the like, and the real sound receiving point where the performance is listened may be set in different spaces. The manner (the number of regions, and/or the division pattern) of division into the sound source element regions may be identical with that of the sound receiving element regions. When the real sound source which gives a performance or the like, and the real sound receiving point where the performance is listened are set at the same position in the same space, and the manner of division into the sound source element regions is identical with that of the sound receiving element regions, the microphones and the loudspeakers may be respectively paired in accordance with the division manner.

According to the sound field reproducing method of the present invention, for example, impulse responses are obtained while setting the sound source and the sound receiving point at the same position on a stage in a sound field (a concert hall or the like) which is to be reproduced, the microphones and the loudspeakers are placed in a real space (such as a studio or a laboratory) in which a performance is to be given, while setting the real sound source and the real sound receiving point at the same position, and a series of operations of the pickups by the microphones, the convolution operations with impulse responses, and the playbacks by the loudspeakers are performed in real time. Therefore, a performer can conduct a rehearsal in an atmosphere which enables the performer to feel as if the performer is on the stage. For example, impulse responses are obtained while setting the sound source onto a stage in a sound field which is to be reproduced, and the sound receiving point into audience seats, a performance is picked up and recorded while the microphones are placed around the real sound source in the real space in which the performance is given, the recorded performance is played back, convolution operations with corresponding impulse responses are performed, and playbacks from the loudspeakers surrounding the real sound receiving point are performed. Therefore, a performer oneself can check how the performance is listened in the audience seats. For example, impulse responses are obtained while setting the sound source onto a stage in a sound field which is to be reproduced, and the sound receiving point into audience seats, a performance is picked up and recorded while the microphones are placed around the real sound source in the real space in which the performance is given, convolution operations with corresponding impulse responses are performed in real time, and playbacks from the loudspeakers surrounding the real sound receiving point in another real space are performed. Therefore, a live concert in remote places can be performed.

According to the second aspect of the present invention, there is provided sound field reproducing apparatus which comprises a convolution operating unit, in which impulse responses are set as parameters of convolution operations, for each of combinations of sound source element regions and sound receiving element regions, wherein each of the impulse responses is obtained in a sound field which is to be reproduced and in which a space surrounding a sound source disposed in the sound field is divided into the sound source element regions of an appropriate solid angle in which the sound source is centered, a space surrounding a sound receiving point disposed in the sound field is divided into the sound receiving element regions of an appropriate solid angle in which the sound receiving point is centered, and a sound radiated from the sound source is emitted from at least one of the sound source element regions, passes through the sound field, enters at least one of the sound receiving element regions, and reaches the sound receiving point, an adder which additively combines output signals of the convolution operating unit for each of combinations of the corresponding sound receiving element regions, a plurality of microphones placed at positions which surround a real sound source in an arbitrary real space and at an appropriate distance in directions corresponding to the sound source element regions, respectively, and a plurality of loudspeakers placed at positions which surround a real sound receiving point in an arbitrary real space and at an appropriate distance in directions corresponding to the sound receiving element regions, respectively, wherein a sound radiated from the real sound source is picked up by the microphones, pickup signals are subjected to convolution operations by the convolution operating unit with the impulse responses which relate to the sound source element regions of corresponding directions, respectively, and sound signals which are obtained by the convolution operations are additively combined by the adder for each of the sound receiving element regions of corresponding directions, and then reproduced from the loudspeakers which are placed correspondingly with the sound receiving element regions, respectively. Accordingly, it is possible to implement the sound field reproducing method of the present invention. In this case, the sound source and the sound receiving point are set at the same position in the sound field which is to be reproduced, the real sound source and the real sound receiving point are set at the same position in the same space, and a series of operations of the pickups by the microphones, the convolution operations with impulse responses, and the playbacks by the loudspeakers are performed in real time, a performer can conduct a rehearsal in an atmosphere which enables the performer to feel as if the performer is, for example, on the stage.

According to the third aspect of the present invention, there is provided sound field reproducing apparatus which comprises a convolution operating unit, in which impulse responses are set as parameters of convolution operations, for each of combinations of sound source element regions and sound receiving element regions, wherein each of the impulse responses is obtained in a sound field which is to be reproduced and in which a space surrounding a sound source disposed in the sound field is divided into the sound source element regions of an appropriate solid angle in which the sound source is centered, a space surrounding a sound receiving point disposed at a different position in the sound field is divided into the sound receiving element regions of an appropriate solid angle in which the sound receiving point is centered, and a sound radiated from the sound source is emitted from at least one of the sound source element regions, passes through the sound field, enters at least one of the sound receiving element regions, and reaches the sound receiving point, an adder which additively combines output signals of the convolution operating unit for each of combinations of corresponding sound receiving element regions, a plurality of microphones placed at positions which surround a real sound source in an arbitrary real space and at an appropriate distance in directions corresponding to the sound source element regions, respectively, a recording and playing back apparatus which records and plays back signals picked up by the microphones, and a plurality of loudspeakers placed at positions which surround a real sound receiving point in an arbitrary real space and at an appropriate distance in directions corresponding to the sound receiving element regions, respectively, wherein a sound radiated from the real sound source is picked up by the microphones, the picked up sounds are recorded by the recording and playing back apparatus and then played back, the played back pickup signals of the microphones are subjected to the convolution operations by the convolution operating unit with the impulse responses which relate to the sound source element regions of corresponding directions, respectively, and sound signals which are obtained by the convolution operations are additively combined by the adder for each of the sound receiving element regions of corresponding directions, and then played back from the loudspeakers which are placed correspondingly to the sound receiving element regions, respectively. Accordingly, a performer oneself can check how the performance is listened, for example, in the audience seats. In the case where recorded signals which are picked up by microphones placed at positions which surround a real sound source in an arbitrary real space, and which are at an appropriate distance in directions corresponding to the sound source element regions, respectively are prepared, the sound field reproduction may be performed by a playback-only apparatus in place of the recording and playing back apparatus.

According to the fourth aspect of the present invention, there is provided sound field reproducing apparatus which comprises a convolution operating unit, in which impulse responses are set as parameters of convolution operations, for each of combinations of sound source element regions and sound receiving element regions, wherein each of the impulse responses is obtained in a sound field which is to be reproduced and in which a space surrounding a sound source disposed in the sound field is divided into the sound source element regions of an appropriate solid angle in which the sound source is centered, a space surrounding a sound receiving point disposed at a different position in the sound field is divided into the sound receiving element regions of an appropriate solid angle in which the sound receiving point is centered, and a sound radiated from the sound source is emitted from at least one of the sound source element regions, passes through the sound field, enters at least one of the sound receiving element regions, and reaches the sound receiving point, an adder which additively combines output signals of the convolution operating unit for each of combinations of the corresponding sound receiving element regions, a playing back apparatus that plays back signals picked up by a plurality of microphones placed at positions which surround a real sound source in an arbitrary real space, and which are at an appropriate distance in directions corresponding to the sound source element regions, respectively, and a plurality of loudspeakers placed at positions which surround a real sound receiving point in an arbitrary real space, and which are at an appropriate distance in directions corresponding to the sound receiving element regions, respectively, wherein the pickup signals of the microphones which are to be played back by the playing back apparatus are subjected to the convolution operations by the convolution operating unit with the impulse responses which relate to the sound source element regions of corresponding directions, respectively, and sound signals which are obtained by the convolution operations are additively combined by the adder for each of the sound receiving element regions of corresponding directions, and then played back from the loudspeakers which are placed correspondingly with the sound receiving element regions, respectively.

DETAILED DESCRIPTION OF THE PREFERRED EMBODIMENTS

Figure 2:
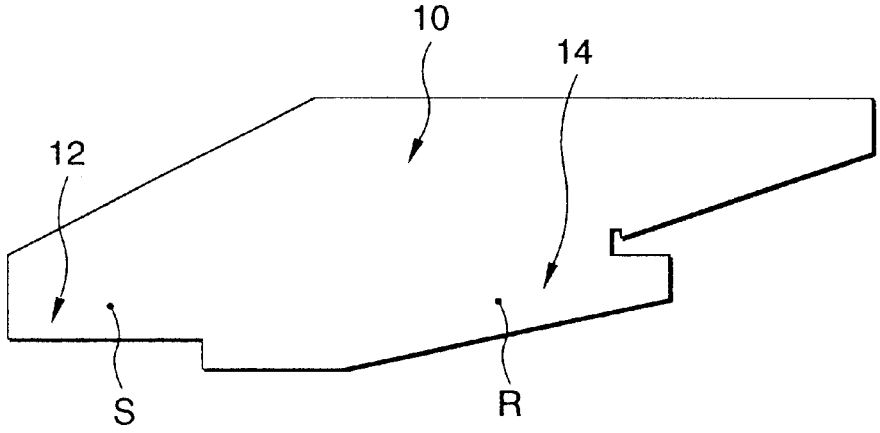
FIG. 2 is a longitudinal side section view showing an example of a sound field which is to be reproduced.
Figure 3:
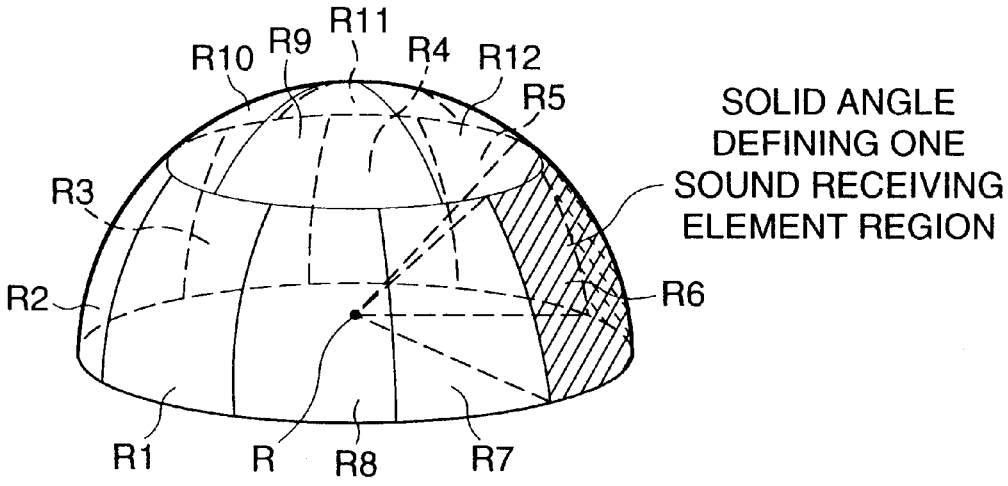
FIG. 3 is a perspective view showing an example of a manner of division into sound receiving element regions in a sound field reproducing technique of the related art.
Figure 4:
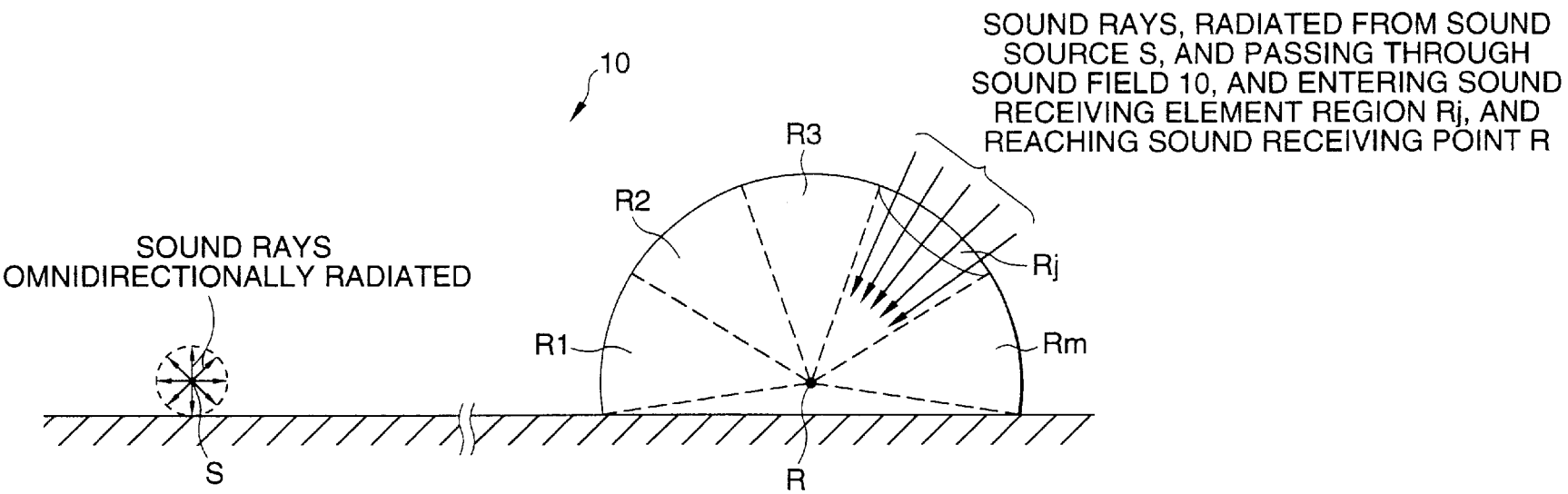
FIG. 4 is a view illustrating a technique of producing impulse responses in the audience seat mode in the sound field reproducing technique of the related art.
Figure 5:
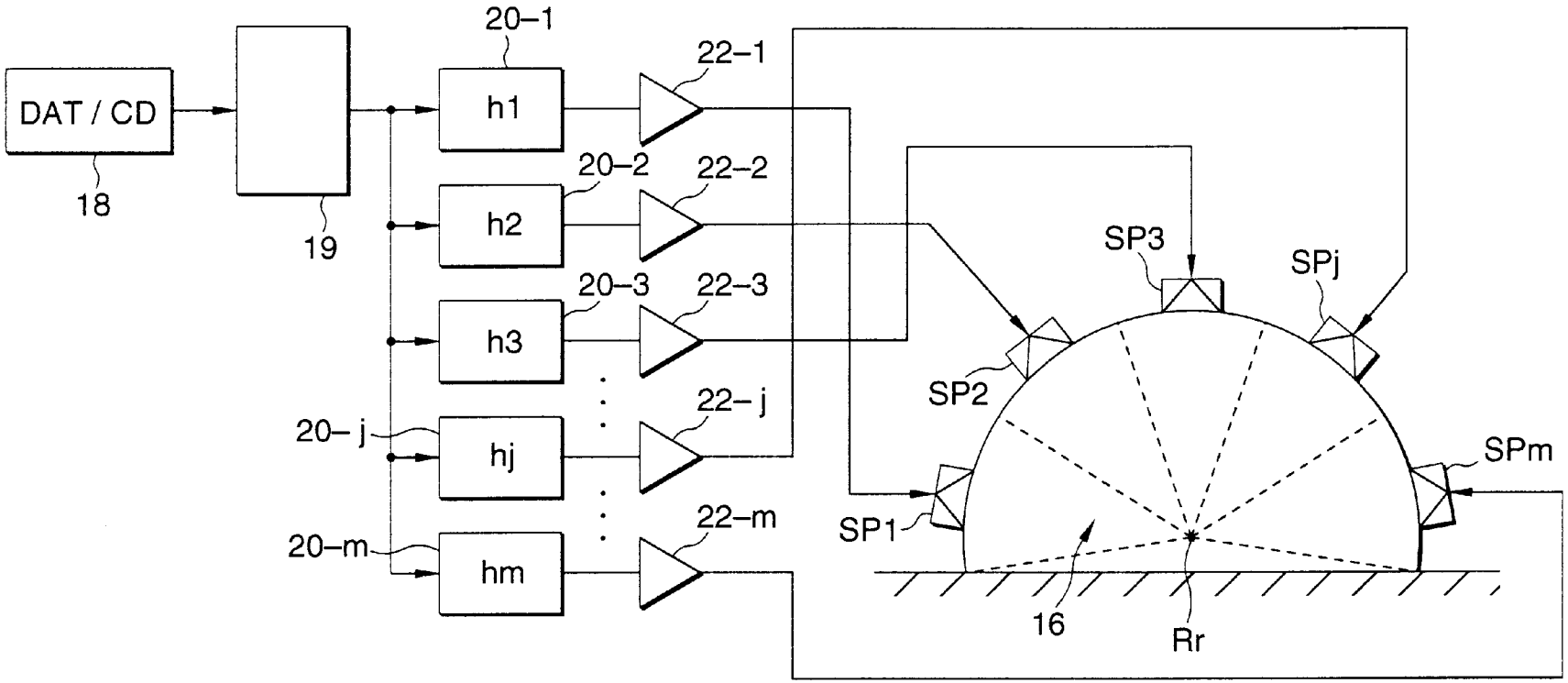
FIG. 5 is a block diagram showing the system configuration of a sound field reproducing apparatus in the audience seat mode of the related art and using impulse responses which are produced by the technique of FIG. 4.
Figure 6:
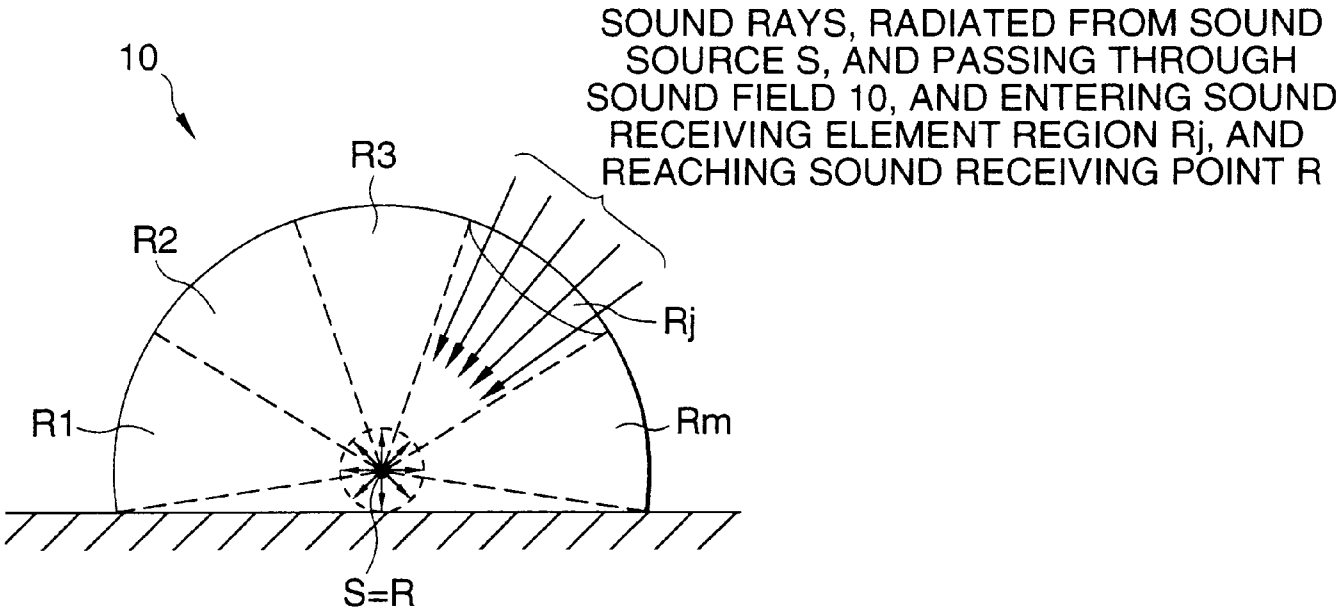
FIG. 6 is a view illustrating a technique of producing impulse responses in a stage mode in the sound field reproducing technique of the related art.
Figure 7:
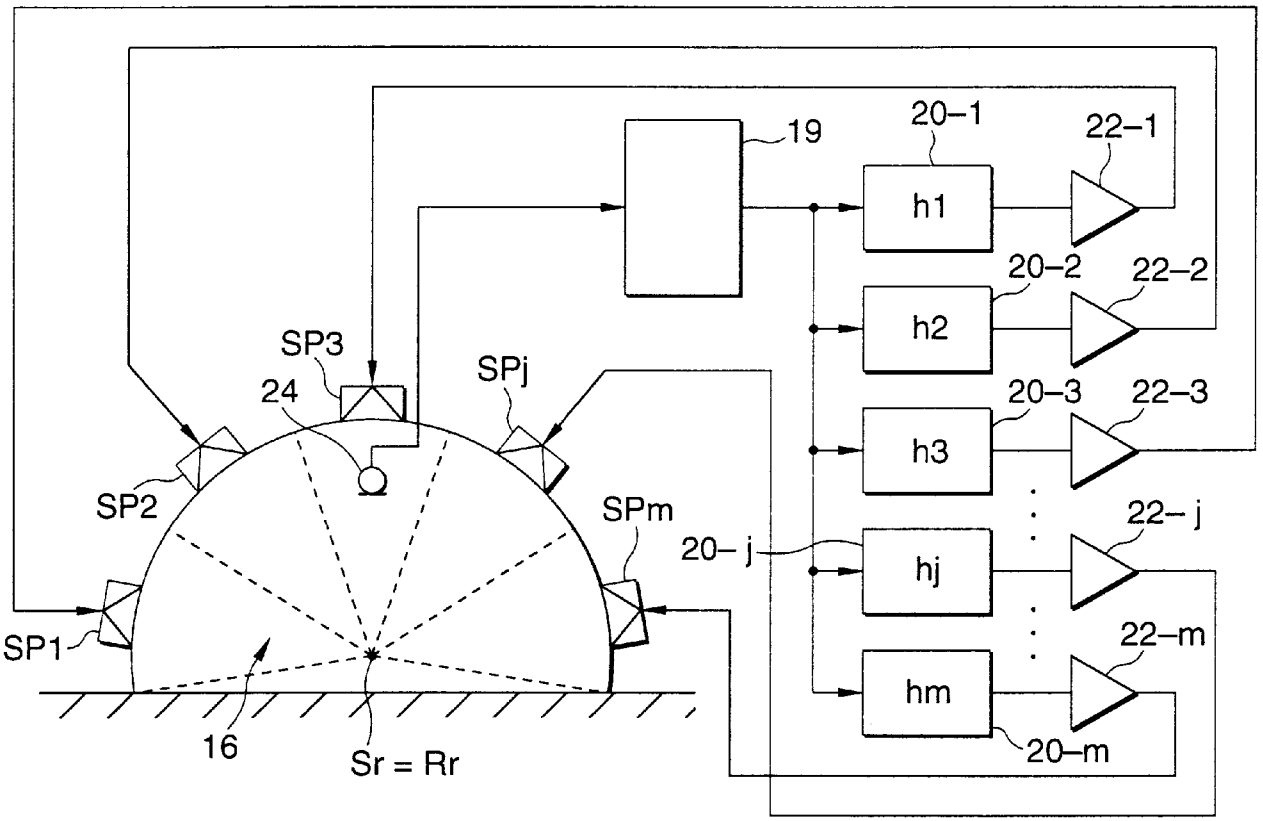
FIG. 7 is a block diagram showing the system configuration of a sound field reproducing apparatus in the stage mode of the related art and using impulse responses which are produced by the technique of FIG. 6.

Preferred embodiments of the present invention will be described. In the description, it is assumed that the sound filed 10 of FIG. 2 is to be reproduced.

1. First Embodiment

Figure 8:
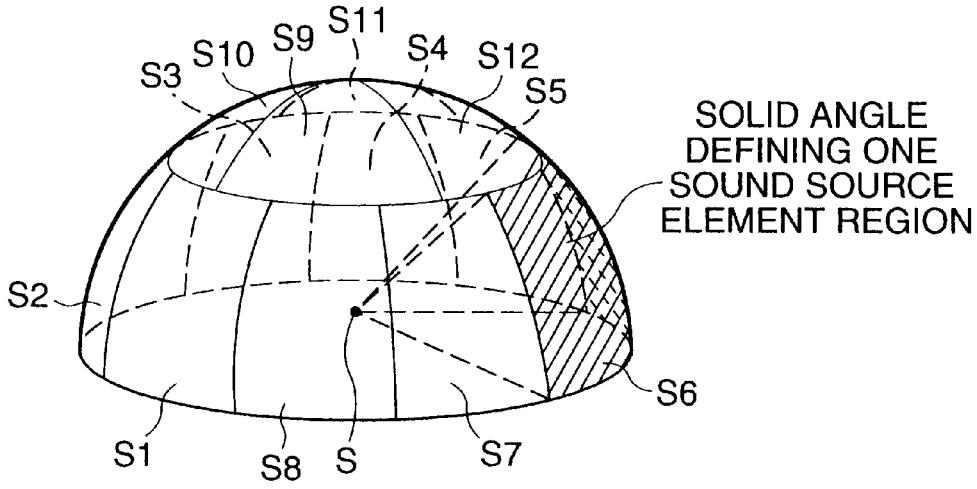
FIG. 8 is a perspective view showing an example of a manner of division into sound source element regions in a sound field reproducing technique of the present invention.
Figure 9:
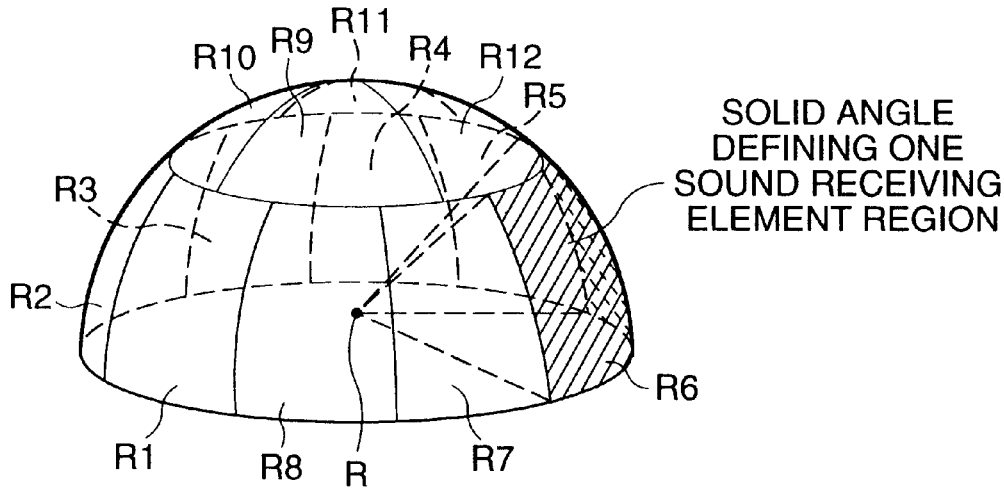
FIG. 9 is a perspective view showing an example of a manner of division into sound receiving element regions in the sound field reproducing technique of the present invention.
Figure 10:
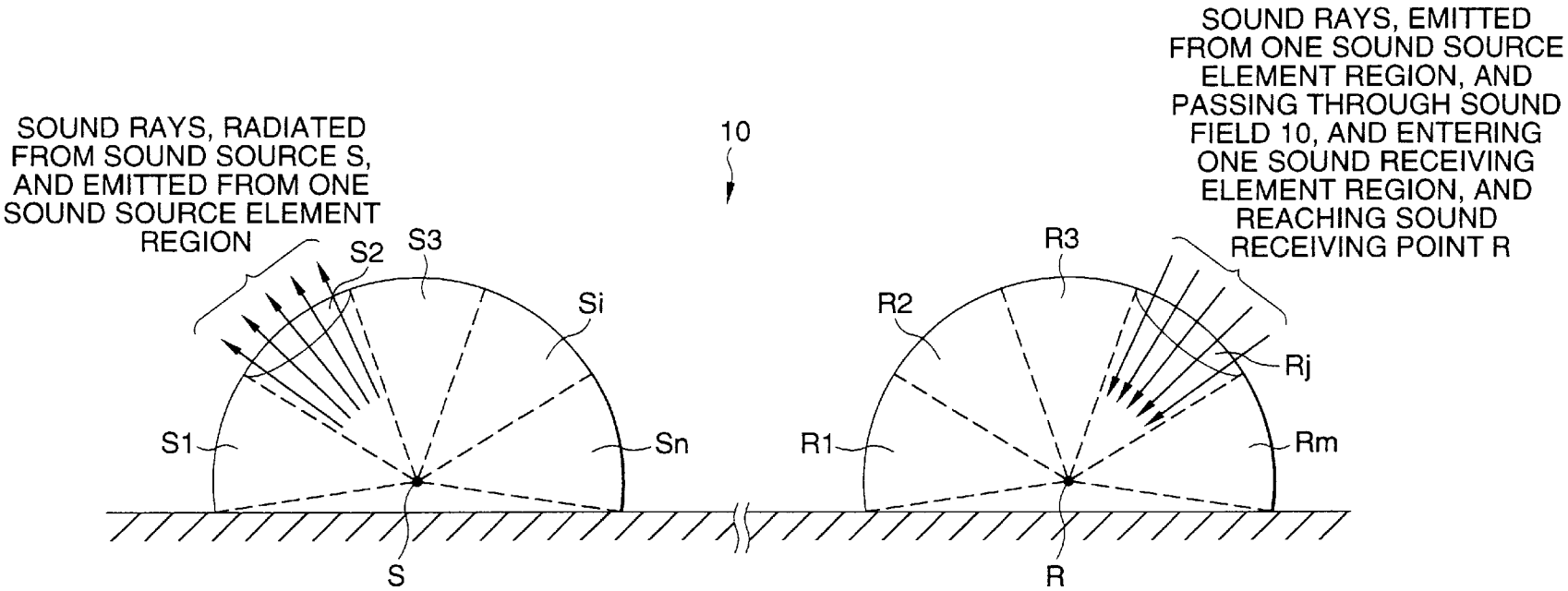
FIG. 10 is a view illustrating a technique of producing impulse responses in the audience seat mode in the sound field reproducing technique of the present invention.

The case will be described where a state in which a performance is given by the sound source S on the stage 12 and the performance is listened at the sound receiving point R in the audience seats 14 is to be reproduced (hereinafter, referred to as audience seat mode). As shown in FIG. 8, a space (a substantially hemisphere space above the floor) surrounding the sound source S is divided into sound source element regions S1, S2, . . . , Si, . . . , and Sn of an appropriate solid angle in which the sound source S is centered. In the example of FIG. 8, the horizontal plane is divided into eight regions, and the obliquely upper area into four regions. In total, the space is divided into twelve regions (n=12). As shown in FIG. 9, a space (a substantially hemisphere space above the floor) surrounding the sound receiving point R is divided into sound receiving element regions R1, R2, . . . , Rj, . . . , and Rm of an appropriate solid angle in which the sound receiving point R is centered. In the example of FIG. 9, the horizontal plane is divided into twelve regions in the same manner as the sound source element regions of FIG. 8 (n and m=12). As shown in FIG. 10 (the sound source element regions Si to Sn and the sound receiving element regions R1 to Rm of FIG. 10 diagrammatically show the manner of the division in FIGS. 8 and 9), an impulse response when a sound radiated from the sound source S is emitted from one of the sound source element regions S1 to Sn, passes directly or reflectingly through the sound field 10, enters one of the sound receiving element regions R1 to Rm, and then reaches the sound receiving point R is obtained by calculation or measurement for each of combinations of all the sound source element regions S1 to Sn and all the sound receiving element regions R1 to Rm. As a result, n'm kinds of impulse responses hi,j (i=1, 2, . . . , n, and j=1, 2, . . . , m) shown in Table 1 below are obtained.

TABLE 1

| |
|---|
| hl,1: Impulse response of a sound which is radiated from the sound source S, emitted from the sound source element region S1, passes through the sound field 10, enters the sound receiving element region R1, and then reaches the sound receiving point R. |
| hl,2: Impulse response of a sound which is radiated from the sound source S, emitted from the sound source element region S1, passes through the sound field 10, enters the sound receiving element region R2, and then reaches the sound receiving point R. |
| . |
| . |
| . |
| h1,m: Impulse response of a sound which is radiated from the sound source S, emitted from the sound source element region S1, passes through the sound field 10, enters the sound receiving element region Rm, and then reaches the sound receiving point R. |
| h2,1: Impulse response of a sound which is radiated from the sound source S, emitted from the sound source element region S2, passes through the sound field 10, enters the sound receiving element region R1, and then reaches the sound receiving point R. |
| h2,2: Impulse response of a sound which is radiated from the sound source S, emitted from the sound source element region S2, passes through the sound field 10, enters the sound receiving element region R2, and then reaches the sound receiving point R. |
| . |
| . |
| . |
| h2,m: Impulse response of a sound which is radiated from the sound source S, emitted from the sound source element region S2, passes through the sound field 10, enters the sound receiving element region Rm, and then reaches the sound receiving point R. |
| . |
| . |
| . |
| hn,1: Impulse response of a sound which is radiated from the sound source S, emitted from the sound source element region Sn, passes through the sound field 10, enters the sound receiving element region R1, and then reaches the sound receiving point R. |
| hn,2: Impulse response of a sound which is radiated from the sound source S, emitted from the sound source element region Sn, passes through the sound field 10, enters the sound receiving element region R2, and then reaches the sound receiving point R. |
| . |
| . |
| . |
| hn,m: Impulse response of a sound which is radiated from the sound source S, emitted from the sound source element region Sn, passes through the sound field 10, enters the sound receiving element region Rm, and then reaches the sound receiving point R. |

Figure 1:
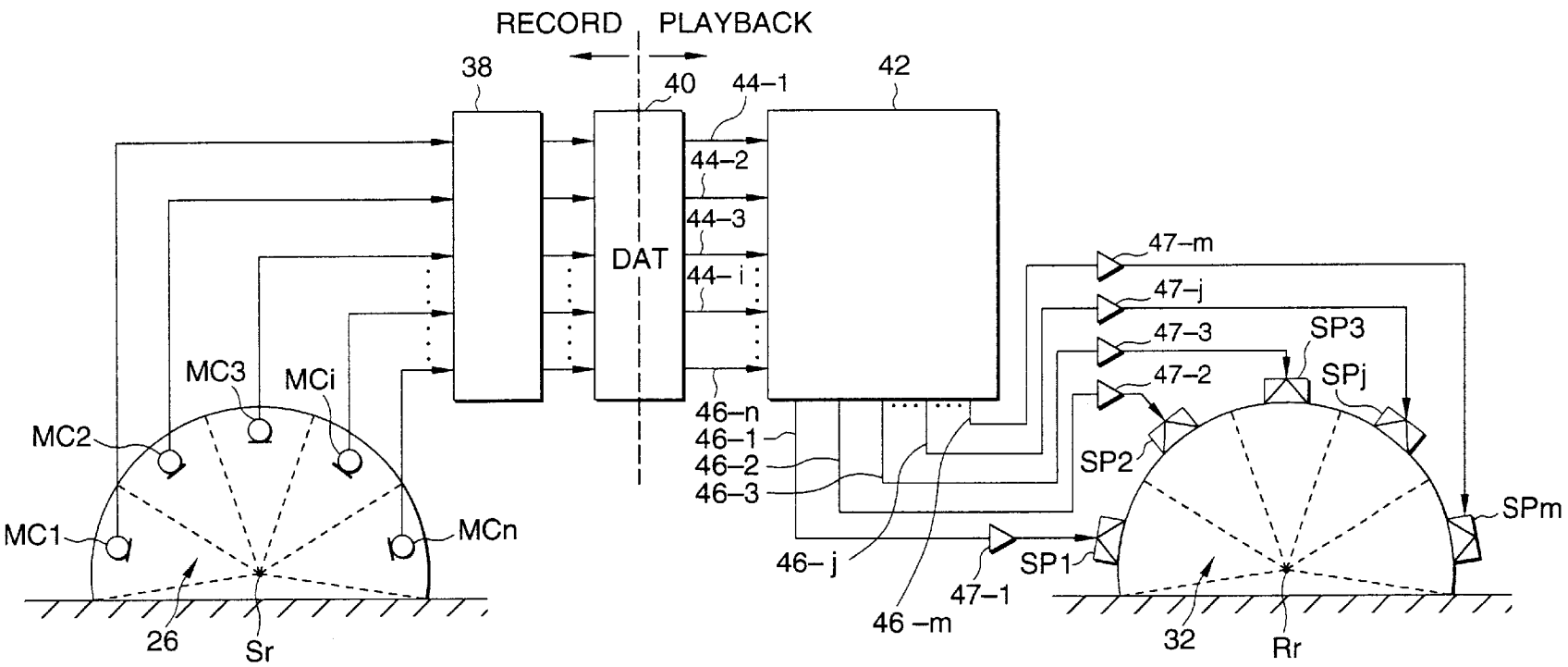
FIG. 1 is a block diagram showing a first embodiment of the sound field reproducing apparatus of the present invention, and showing the system configuration of the sound field reproducing apparatus in an audience seat mode using impulse responses which are produced by a technique of FIG. 10.

FIG. 1 shows an example of the configuration of a system for reproducing the sound field in an arbitrary real space on the basis of the obtained impulse responses hi,j. The real space 26 in which a performer gives a performance is provided with acoustic properties in which the floor has reflection properties of a predetermined sound absorption coefficient, and portions other than the floor have dead sound absorption properties (properties of a semi-anechoic chamber, a studio, or the like). Directional microphones MC1 to MCn are placed around a real sound source Sr (performing position) in the space 26 and in the directions corresponding to the sound source element regions S1 to Sn (FIG. 8) so as to be directed toward the sound source Sr (in FIG. 1, the positions where the microphones MC1 to MCn are placed are diagrammatically shown in accordance with the manner of showing the sound source element regions S1 to Sn in FIG. 10). Preferably, a real space 32 in which a listener actually listens a performance sound is provided with dead acoustic properties. Loudspeakers SP1 to SPm are placed around a real sound receiving point Rr (listening position) in the space 32 and in the directions corresponding to the sound receiving element regions R1 to Rm (FIG. 9) so as to be directed toward the sound receiving point Rr (in FIG. 1, the positions where the loudspeakers SP1 to SPm are placed are diagrammatically shown in accordance with the manner of showing the sound receiving element regions R1 to Rm in FIG. 10).

The performer gives a performance at the position of the sound source Sr in the space 26. The performance sound is picked up by the microphones MC1 to MCn, and then subjected to multichannel recording by a DAT 40 via a head amplifier 38. When the performance is ended, the recorded performance is played back. The pickup signals of the microphones MC1 to MCn which are played back from the DAT 40 are input into an FIR matrix circuit 42. The FIR matrix circuit 42 is configured by arranging into a matrix form an n m number of FIR filters (convolution operating units) in which the impulse responses hi,j are respectively set as parameters, and adders each of which additively combines output signals of the FIR filters that are common in the sound receiving element region.

Figure 11:
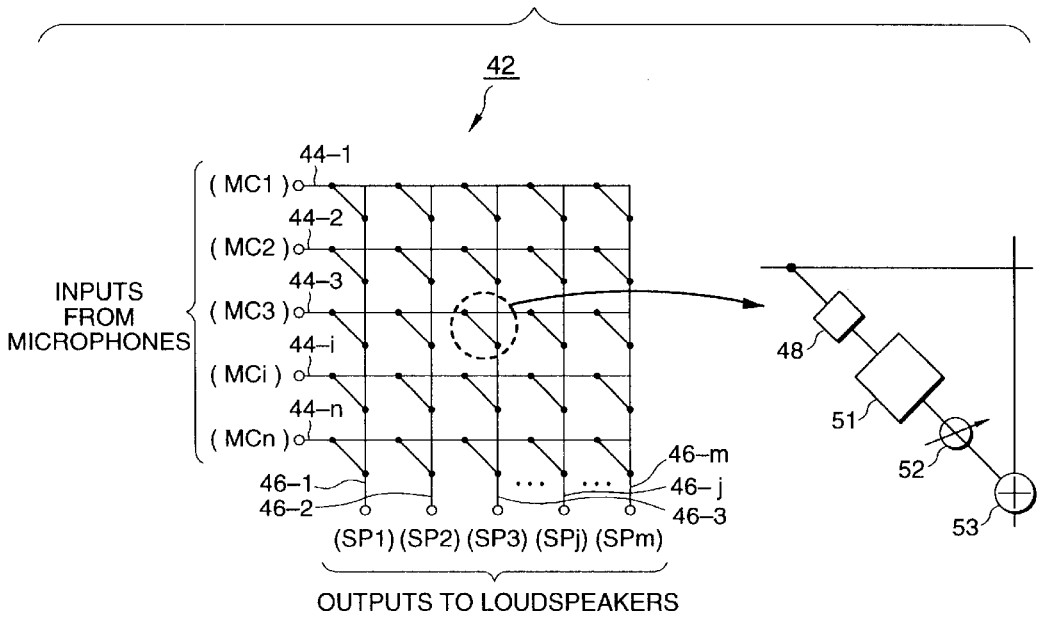
FIG. 11 is a circuit diagram showing an example of the configuration of an FIR matrix circuit 42 in FIGS. 1 and 13.

FIG. 11 shows an example of the configuration of the FIR matrix circuit 42. The FIR matrix circuit 42 has an n number of input lines 44-1 to 44-n through which the pickup signals of the microphones MC1 to MCn are respectively input, and an m number of output lines 46-1 to 46-m through which signals to be supplied to the loudspeakers SP1 to SPm are respectively output. A series circuit of an equalizer 48, an FIR filter (convolution operating unit) 51, an attenuator 52, and an adder 53 is disposed in each of an n×m number of intersections of the input and output lines, so as to correspondingly connect the input and output lines. The parameter of the impulse response which is obtained for a combination of the corresponding sound source element region and sound receiving element region is set in the FIR filter 51. The equalizer 48 is used for correcting properties of the loudspeaker, and the attenuator 52 is used for individually performing the level adjustment. When the equalizer and the attenuator are once set, usually, it is not required to change the settings as far as the same system configuration is employed. The adder 53 additively combines an output signal output from the attenuator 52, to one of the output lines 46-1 to 46-m. The pickup signals of the microphones MC1 to MCn which are input through the input lines 44-1 to 44-n are subjected to a convolution operation with impulse responses which relate to corresponding sound source element regions, respectively, and sound signals (a direct sound, a reflected sound, and a reverberation sound) are produced. The sound signals of the corresponding sound source element region and sound receiving element region are additively combined with each other, and the resulting signals are respectively output through the corresponding output lines 46-1 to 46-m.

Referring to FIG. 1, the sound signals which are output through the output lines 46-1 to 46-m of the FIR matrix circuit 42 are amplified by amplifiers 47-1 to 47-m, and then supplied to the corresponding loudspeakers SP1 to SPm in the space 32 to be played back thereby. The combinations of the microphones which are used in the pickups, the impulse responses which are used in the convolution operations, and the loudspeakers which are used in the playbacks are listed in Table 2 below.

TABLE 2

| Microphone | Impulse response | Loudspeaker |
|---|---|---|
| MC1 | h1,1 | SP1 |
| MC1 | h1,2 | SP2 |
| . | . | . |
| . | . | . |
| . | . | . |
| MC1 | h1,m | SPm |
| MC2 | h2,1 | SP1 |
| MC2 | h2,2 | SP2 |
| . | . | . |
| . | . | . |
| . | . | . |
| MC2 | h2,m | SPm |
| . | . | . |
| . | . | . |
| . | . | . |
| MCn | hn,1 | SP1 |
| MCn | hn,2 | SP2 |
| . | . | . |
| . | . | . |
| . | . | . |
| MCn | hn,m | SPm |

Accordingly, in the whole of the space 32 in which the listener exists, a playback signal r indicated by the following numerical expression 1 is reproduced.

$$r = \sum_{j=1}^{m} r_j = \sum_{j=1}^{m} \sum_{i=1}^{n} S_i * h_{i,j} \qquad \text{Numerical Expression 1}$$

In the above numerical expression 1, "Si" is the pickup signal obtained by the microphone MCi (i=1, 2, . . . , n), and "rj" is the playback signal to be reproduced by the loudspeaker SPj (j=1, 2, . . . , m). Therefore, the state where, in the sound field 10 of FIG. 2, the music performed on the stage 12 is listened in the audience seats 14 is reproduced with including the directional properties of the musical instrument and the direction of the performer. Namely, differences of instruments of different directional properties, such as a trumpet and a violin, and a flute and a piano appear in the reproduced sound field. Furthermore, differences of performance conditions can be expressed, for example, in such a manner that, when the performer faces a wall the bounce from the wall is strong, and, when the performer turns the back to the wall, the bounce is weak.

When the system configuration of FIG. 1 is used, for example, a performer gives a performance in the space 26, the performance is recorded by the DAT 40, and, after the recording, the performer can playback the performance to listen it in the space 32, thereby enabling the performer oneself to check how the performance is listened in the audience seats 14. It is not required that the space 26 in which a performance is given is different from the space 32 in which the performance is listened. The microphones MC1 to MCn and the loudspeakers SP1 to SPm may be placed in a common space. In this case, when n=m is set, the microphones MC1 to MCn and the loudspeakers SP1 to SPm may be placed with being correspondingly paired with each other. In FIG. 1, the single DAT 40 is used for both the recording and the playback. Alternatively, a recording apparatus and a playing back apparatus may be prepared in the spaces 26 and 32, respectively. In the alternative, a recording medium on which recording has been conducted by the recording apparatus in the space 26 may be transported to a place where the space 32 exists, and the medium is subjected to playback by the playing back apparatus, thereby reproducing a sound field. The system configuration of FIG. 1 may be modified so that the spaces 26 and 32 are configured by separate spaces, the DAT 40 is not used, the pickups, the convolution operations, and the playbacks are performed in real time, and a performance in the space 26 is listened in the space 32. According to this configuration, a live concert can be performed in an atmosphere which enables the listener to feel as if the listener is in the sound field 10 of FIG. 2, by using a communication line between the spaces 26 and 32 which are remote from each other.

2. Second Embodiment

Figure 12:
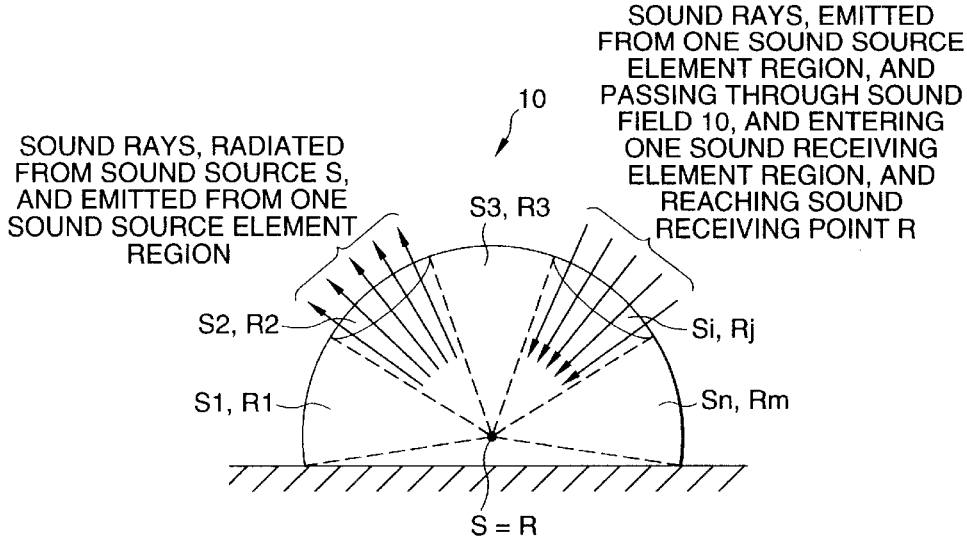
FIG. 12 is a view illustrating a technique of producing impulse responses in a stage mode in the sound field reproducing technique of the present invention.

The case will be described where a state in which a performance is given in an atmosphere that enables a performer oneself to feel as if the performer is on the stage 12 in the sound field 10 (hereinafter, referred to as stage mode). In this case, the sound source S on the stage 12 functions also as the sound receiving point R. As shown in FIG. 8, a space surrounding the sound source S is divided into sound source element regions S1, S2, . . . , Si, . . . , and Sn of an appropriate solid angle in which the sound source S is centered. In the example of FIG. 8, the horizontal plane is divided into eight regions, and the obliquely upper area into four regions. In total, the space is divided into twelve regions (n=12). As shown in FIG. 9, a space (which, in the second embodiment, is common to the space surrounding the sound source S) surrounding the sound receiving point R is divided into sound receiving element regions R1, R2, . . . , Rj, . . . , and Rm of an appropriate solid angle in which the sound receiving point R is centered. In the example of FIG. 9, the horizontal plane is divided into twelve regions in the same manner as the sound source element regions of FIG. 8 (n and m=12). As shown in FIG. 12 (the sound source element regions S1 to Sn and the sound receiving element regions R1 to Rm of FIG. 12 diagrammatically show the manner of the division in FIGS. 8 and 9), an impulse response when a sound radiated from the sound source S is emitted from one of the sound source element regions S1 to Sn, passes directly or reflectingly through the sound field 10, enters one of the sound receiving element regions R1 to Rm, and then reaches the sound receiving point R is obtained by calculation or measurement for each of combinations of all the sound source element regions S1 to Sn and all the sound receiving element regions R1 to Rm. As a result, n x m kinds of impulse responses hi,j (i=1, 2, . . . , n, and j=1, 2, . . . , m) shown in Table 1 above are obtained.

In an actual concert hall, both in the audience seats and on the stage, a sound which has reached the sound receiving point R is further reflected by the floor and the like so as to repeat reflection to again reach the sound receiving point R. In the audience seat mode, the pickup by a microphone and the playback by a loudspeaker are not simultaneously performed (or are performed in separate spaces), and hence an impulse response can be produced so as to contain the repetition of the sound which has reached the sound receiving point R. By contrast, in the stage mode, the pickup by a microphone and the playback by a loudspeaker are simultaneously performed, and hence the sound played back by a loudspeaker is picked up by a microphone to form a feedback loop. In this case, if an impulse response is produced so as to contain the repetition of the sound which has reached the sound receiving point R, reflected sounds reaching through the feedback loop are added, so that reflected sounds which are large in number than those that are actually listened on the stage are produced. In the stage mode, the feedback loop cannot be omitted. Therefore, it is preferable to use impulse responses which do not contain repetition of a sound reaching the sound receiving point R, in place of those containing such repetition. In other words, when impulse responses are to be obtained by calculation in the stage mode, sound rays which have once reached the receiving point R are caused to vanish there so as not to repeat repetition anymore.

Figure 13:
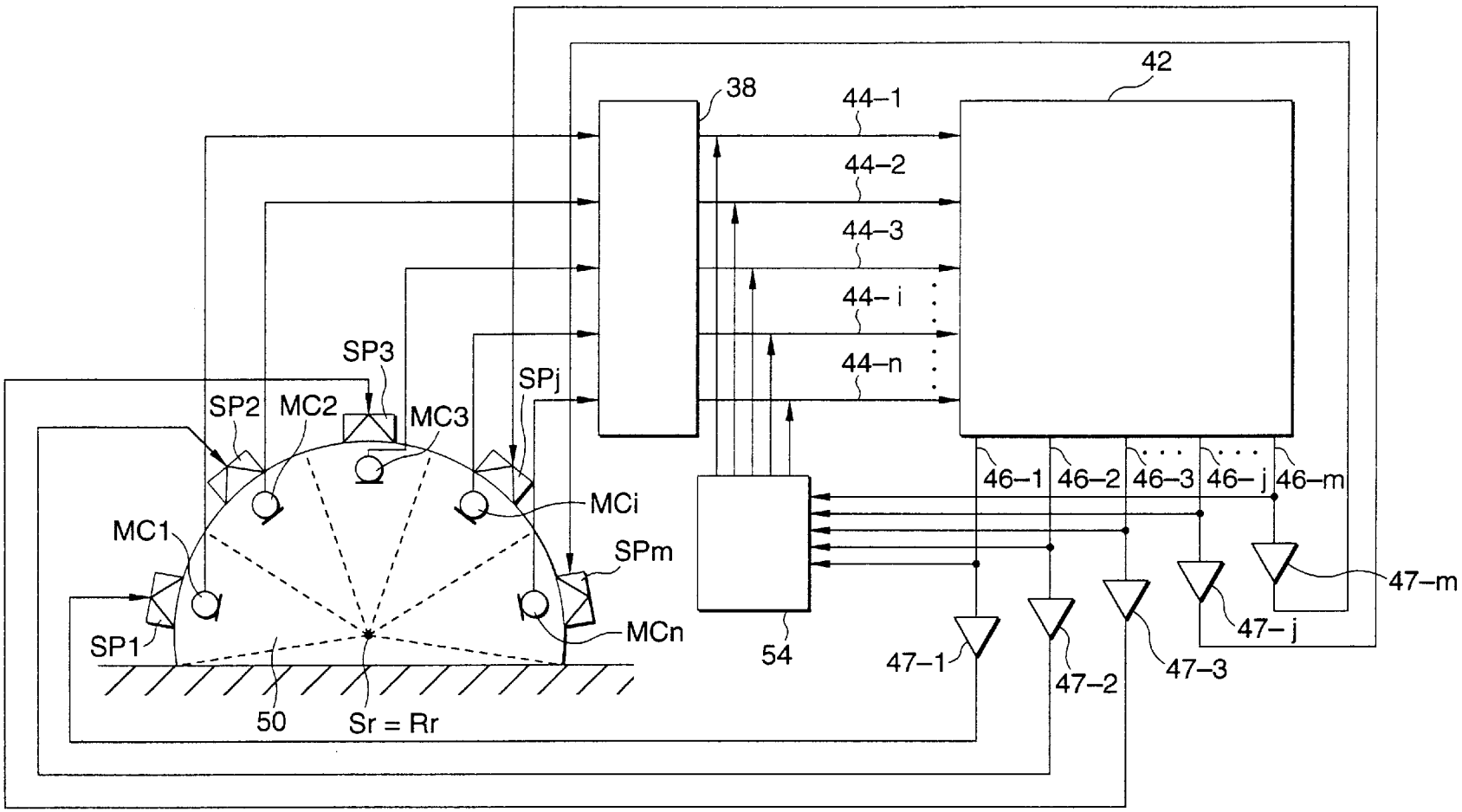
FIG. 13 is a block diagram showing a second embodiment of the sound field reproducing apparatus of the present invention, and showing the system configuration of the sound field reproducing apparatus in the stage mode using impulse responses which are produced by the technique of FIG. 12.

FIG. 13 shows the configuration of a system for reproducing the sound field in an arbitrary real space on the basis of the obtained impulse responses hi,j. The real space 50 in which a performer gives a performance and the performance is listened in real time is provided with acoustic properties in which the floor has reflection properties of a predetermined sound absorption coefficient, and portions other than the floor have dead sound absorption properties (properties of a semi-anechoic chamber, a studio, or the like). Directional microphones MC1 to MCn are placed around a real sound source Sr (performing position) in the space 50 and in the directions corresponding to the sound source element regions S1 to Sn (FIG. 8) so as to be directed toward the sound source Sr (in FIG. 13, the positions where the microphones MC1 to MCn are placed are diagrammatically shown in accordance with the manner of showing the sound source element regions S1 to Sn in FIG. 12). Loudspeakers SP1 to SPm are placed around a real sound receiving point Rr (listening position) in the space 50 and in the directions corresponding to the sound receiving element regions R1 to Rm (FIG. 9) so as to be directed toward the sound receiving point Rr (in FIG. 13, the positions where the loudspeakers SP1 to SPm are placed are diagrammatically shown in accordance with the manner of showing the sound receiving element regions R1 to Rm in FIG. 12). When n=m is set, the microphones MC1 to MCn and the loudspeakers SP1 to SPm may be placed with being correspondingly paired with each other.

The performer gives a performance at the position of the sound source Sr in the space 50. The performance sound is picked up by the microphones MC1 to MCn, and then input into an FIR matrix circuit 42 via a head amplifier 38. The FIR matrix circuit 42 is configured by arranging into a matrix form an n×m number of FIR filters (convolution operating units) in which the impulse responses hi,j are respectively set as parameters, and adders each of which additively combines output signals of the FIR filters that are common in the sound receiving element region. For example, the FIR matrix circuit may be configured as shown in FIG. 11. The pickup signals of the microphones MC1 to MCn which are input through the input lines 44-1 to 44-n are subjected to a convolution operation with impulse responses which relate to corresponding sound source element regions, respectively, and sound signals (a direct sound, a reflected sound, and a reverberation sound) are produced. The sound signals of the corresponding sound source element region and sound receiving element region are additively combined with each other, and the resulting signals are output through the corresponding output lines 46-1 to 46-m.

Referring to FIG. 13, the sound signals which are output through the output lines 46-1 to 46-m of the FIR matrix circuit 42 are amplified by amplifiers 47-1 to 47-m, and then supplied to the corresponding loudspeakers SP1 to SPm in the space 50 to be played back thereby. The combinations of the microphones which are used in the pickups, the impulse responses which are used in the convolution operations, and the loudspeakers which are used in the playbacks are identical with those listed in Table 2 above. In order to prevent howling from occurring, an echo canceler 54 is disposed so that signals which are obtained by subtracting the output signals of the loudspeakers SP1 to SPm from the pickup signals of the microphones MC1 to MCn which are paired with the loudspeakers, respectively are input into the FIR matrix circuit 42.

As a result, in the whole of the space 50, the playback signal r indicated by the aforementioned numerical expression 1 is reproduced. Therefore, the state where the performance is given in an atmosphere that enables the performer oneself to feel as if the performer is on the stage 12 in the sound filed 10 of FIG. 2 is reproduced. When the system configuration of FIG. 13 is used, consequently, a performer can conduct a rehearsal in an atmosphere which enables the performer to feel as if the performer is on the stage 12.

In the first and second embodiments described above, the divisions into the sound source element regions and the sound receiving element regions are performed so that adjacent regions do not overlap with each other. Alternatively, the divisions may be performed so that adjacent regions partially overlap with each other. According to this configuration, a sound which is to be located at the middle between adjacent loudspeakers can be reproduced by simultaneously performing playbacks from the loudspeakers.

What is claimed is:

1. A sound field reproducing method, comprising the steps of:

dividing a space surrounding a sound source disposed in a sound field which is to be reproduced, into sound source element regions of an appropriate solid angle in which the sound source is centered;

dividing a space surrounding a sound receiving point disposed in the sound field, into sound receiving element regions of an appropriate solid angle in which the sound receiving point is centered;

calculating or measuring impulse responses, for each of combinations of the sound source element regions and the sound receiving element regions, wherein each of the impulse responses is calculated or measured in the sound field in which a sound radiated from the sound source is emitted from at least one of the sound source element regions, passes through the sound field, enters at least one of the sound receiving element regions, and reaches the sound receiving point;

placing a plurality of microphones at positions which surround a real sound source in an arbitrary real space and at an appropriate distance in directions corresponding to the sound source element regions, respectively;

placing a plurality of loudspeakers at positions which surround a real sound receiving point in an arbitrary real space and at an appropriate distance in directions corresponding to the sound receiving element regions, respectively;

picking up a sound radiated from the real sound source, by the microphones to produce pickup signals;

subjecting the pickup signals respectively to convolution operations with the impulse responses which are calculated or measured for the sound source element regions in directions corresponding respectively to the sound radiated from the real sound source; and reproducing respectively sound signals which are obtained by the convolution operations, from the loudspeakers which are placed correspondingly to the sound receiving element regions of corresponding directions, respectively.

2. A sound field reproducing method according to claim 1, wherein a series of steps including the picking step, the subjecting step and the reproducing steps, is performed in real time.

3. A sound field reproducing method according to claim 1, further comprising the steps of recording the pickup signals picked up by the microphones, and playing back recorded pickup signals, wherein, in the subjecting step, played back signals are subjected to convolution operations with the impulse responses so as to be played back from the loudspeakers.

4. A sound field reproducing method according to claim 1, wherein the sound source and the sound receiving point are set at the same position in the sound field which is to be reproduced.

5. A sound field reproducing method according to claim 1, wherein the sound source and the sound receiving point are set at different positions in the sound field which is to be reproduced.

6. A sound field reproducing method according to claim 1, wherein the real sound source and the real sound receiving point are set at the same position in the same space.

7. A sound field reproducing method according to claim 1, wherein the real sound source and the real sound receiving point are set in different spaces.

8. A sound field reproducing method according to claim 1, wherein a manner of division into the sound source element regions is identical with a manner of division into the sound receiving element regions.

9. A sound field reproducing method according to claim 6, wherein a manner of division into the sound source element regions is identical with a manner of division into the sound receiving element regions, and the microphones and the loudspeakers are respectively paired in accordance with the division manner.

10. A sound field reproducing apparatus, comprising:

a convolution operating unit, in which impulse responses are set as parameters of convolution operations, for each of combinations of sound source element regions and sound receiving element regions, wherein each of the impulse responses is obtained in a sound field which is to be reproduced and in which a space surrounding a sound source disposed in the sound field is divided into the sound source element regions of an appropriate solid angle in which the sound source is centered, a space surrounding a sound receiving point disposed in the sound field is divided into the sound receiving element regions of an appropriate solid angle in which the sound receiving point is centered, and a sound radiated from the sound source is emitted from at least one of the sound source element regions, passes through the sound field, enters at least one of the sound receiving element regions, and reaches the sound receiving point;

an adder which additively combines output signals of the convolution operating unit for each of combinations of the corresponding sound receiving element regions;

a plurality of microphones placed at positions which surround a real sound source in an arbitrary real space and at an appropriate distance in directions corresponding to the sound source element regions, respectively; and a plurality of loudspeakers placed at positions which surround a real sound receiving point in an arbitrary real space and at an appropriate distance in directions corresponding to the sound receiving element regions, respectively, wherein a sound radiated from the real sound source is picked up by the microphones, pickup signals are subjected to convolution operations by the convolution operating unit with the impulse responses which relate to the sound source element regions of corresponding directions, respectively, and sound signals which are obtained by the convolution operations are additively combined by the adder for each of the sound receiving element regions of corresponding directions, and then reproduced from the loudspeakers which are placed correspondingly with the sound receiving element regions, respectively.

11. A sound field reproducing apparatus according to claim 10, wherein the sound source and the sound receiving point are set at the same position in the sound field which is to be reproduced, and a series of operations of the pickups by the microphones, the convolution operations with impulse responses, and the playbacks by the loudspeakers is performed in real time.

12. A sound field reproducing apparatus, comprising:

a convolution operating unit, in which impulse responses are set as parameters of convolution operations, for each of combinations of sound source element regions and sound receiving element regions, wherein each of the impulse responses is obtained in a sound field which is to be reproduced and in which a space surrounding a sound source disposed in the sound field is divided into the sound source element regions of an appropriate solid angle in which the sound source is centered, a space surrounding a sound receiving point disposed at a different position in the sound field is divided into the sound receiving element regions of an appropriate solid angle in which the sound receiving point is centered, and a sound radiated from the sound source is emitted from at least one of the sound source element regions, passes through the sound field, enters at least one of the sound receiving element regions, and reaches the sound receiving point;

an adder which additively combines output signals of the convolution operating unit for each of combinations of corresponding sound receiving element regions;

a plurality of microphones placed at positions which surround a real sound source in an arbitrary real space and at an appropriate distance in directions corresponding to the sound source element regions, respectively;

a recording and playing back apparatus which records and plays back signals picked up by the microphones; and a plurality of loudspeakers placed at positions which surround a real sound receiving point in an arbitrary real space and at an appropriate distance in directions corresponding to the sound receiving element regions, respectively, wherein a sound radiated from the real sound source is picked up by the microphones, the picked up sounds are recorded by the recording and playing back apparatus and then played back, the played back pickup signals of the microphones are subjected to the convolution operations by the convolution operating unit with the impulse responses which relate to the sound source element regions of corresponding directions, respectively, and sound signals which are obtained by the convolution operations are additively combined by the adder for each of the sound receiving element regions of corresponding directions, and then played back from the loudspeakers which are placed correspondingly to the sound receiving element regions, respectively.

13. A sound field reproducing apparatus, comprising:

a convolution operating unit, in which impulse responses are set as parameters of convolution operations, for each of combinations of sound source element regions and sound receiving element regions, wherein each of the impulse responses is obtained in a sound field which is to be reproduced and in which a space surrounding a sound source disposed in the sound field is divided into the sound source element regions of an appropriate solid angle in which the sound source is centered, a space surrounding a sound receiving point disposed at a different position in the sound field is divided into the sound receiving element regions of an appropriate solid angle in which the sound receiving point is centered, and a sound radiated from the sound source is emitted from at least one of the sound source element regions, passes through the sound field, enters at least one of the sound receiving element regions, and reaches the sound receiving point;

an adder which additively combines output signals of the convolution operating unit for each of combinations of the corresponding sound receiving element regions;

a playing back apparatus that plays back signals picked up by a plurality of microphones placed at positions which surround a real sound source in an arbitrary real space, and which are at an appropriate distance in directions corresponding to the sound source element regions, respectively; and a plurality of loudspeakers placed at positions which surround a real sound receiving point in an arbitrary real space, and which are at an appropriate distance in directions corresponding to the sound receiving element regions, respectively, wherein the pickup signals of the microphones which are to be played back by the playing back apparatus are subjected to the convolution operations by the convolution operating unit with the impulse responses which relate to the sound source element regions of corresponding directions, respectively, and sound signals which are obtained by the convolution operations are additively combined by the adder for each of the sound receiving element regions of corresponding directions, and then played back from the loudspeakers which are placed correspondingly with the sound receiving element regions, respectively.

* * * * *